US011810538B1

(12) United States Patent
Astfalk

(10) Patent No.: US 11,810,538 B1
(45) Date of Patent: Nov. 7, 2023

(54) BLUES HARMONICA

(71) Applicant: Brian Astfalk, Tucson, AZ (US)

(72) Inventor: Brian Astfalk, Tucson, AZ (US)

(73) Assignee: Brian Astfalk, Tucson, AZ (US)

( * ) Notice: Subject to any disclaimer, the term of this patent is extended or adjusted under 35 U.S.C. 154(b) by 6 days.

(21) Appl. No.: 17/846,717

(22) Filed: Jun. 22, 2022

Related U.S. Application Data

(60) Provisional application No. 63/215,868, filed on Jun. 28, 2021.

(51) Int. Cl.
*G10D 7/14* (2020.01)

(52) U.S. Cl.
CPC ..... *G10D 7/14* (2020.02)

(58) Field of Classification Search
CPC ..... G10D 7/14
See application file for complete search history.

(56) References Cited

U.S. PATENT DOCUMENTS

| | | | | | |
|---|---|---|---|---|---|
| 2,511,302 | A * | 6/1950 | Stephenson | G10D 7/14 | 984/137 |
| 2,591,023 | A * | 4/1952 | Stephenson | G10D 7/14 | 84/403 |
| 4,237,766 | A * | 12/1980 | Marshall | G10D 7/14 | 984/137 |
| 5,166,461 | A * | 11/1992 | Salwitz | G10D 7/14 | 84/377 |
| 8,153,875 | B1 * | 4/2012 | Beauregard | G10D 7/14 | 84/330 |
| 8,431,807 | B1 * | 4/2013 | Beauregard, IV | G10D 9/00 | 84/377 |
| 11,610,566 | B2 * | 3/2023 | Müller | G10D 7/14 | |
| 11,688,369 | B1 * | 6/2023 | Astfalk | G10D 7/14 | 84/377 |
| 11,694,661 | B1 * | 7/2023 | Astfalk | G10D 7/14 | 84/377 |

FOREIGN PATENT DOCUMENTS

| | | | | |
|---|---|---|---|---|
| CN | 214624402 U | * | 11/2021 | |
| GB | 2301697 A | * | 12/1996 | G10D 7/123 |

* cited by examiner

*Primary Examiner* — Robert W Horn

(57) ABSTRACT

Abstract: Harmonicas providing more notes and increased playability and musicality when playing blues scales. Disclosed harmonicas also provide functional minor scales.

2 Claims, No Drawings

BLUES HARMONICA

CROSS-REFERENCE TO RELATED APPLICATIONS

This application claims the benefit of provisional patent application No. 63/215,868, filed Jun. 28, 2021 by the present inventor.

Technical Field

The present invention relates to the harmonica, and more particularly to its note arrangement, its "tuning".

Background

The standard harmonica note configuration "Richter Tuning" (Table 1), was invented in the 1800's to play Bohemian marching band music. In the early 20$^{th}$ century musicians found that by bending the reeds (drawing or blowing extra hard on the cavities) other notes could be accessed. People began playing the blues on this harmonica.

Common practice on Richter tuning is to solely employ two blues scales (Tablet) as these are the most useful/easily playable scales it has. On a Key of C harmonica, they are the G blues scale (Table 3) and the D blues scale (Table 4). Blues harmony most often consists of One, Four and Five chords. The soloing harmonica player would ideally like to have the corresponding One, Four and Five blues scales available. As Richter only has two, they are employed in the following manner: you can play cross harp style where you play in the key a fifth higher than the key of the harmonica. Ex. key of C harmonica is played in key of G. The G blues scale is played over the One chord (G7), D blues scale is played over Five chord (D7) and for the Four chord (C7) you make do with the notes of the C blues scale (Table 5) that are available. The 3bs (Ebs) are absent. There is technically a C blues scale in the upper register (Table 6), but it is rarely employed as it must be performed with blow bends, and it is quite high in pitch. Blow bends are far more difficult to affect than draw bends. Alternately, you can play in Key of D with D blues scale played over the One chord (D7), G blues scale played over the Four chord (G7) and for the Five chord (A7) you make do with the notes of the A blues scale (Table 7) that are available. The 5 bs (Ebs) are absent. This is called draw harp. The blues scale can be looked at as the minor pentatonic scale (1,3 b,4,5,7 b) with a 5 b added as that's how it's often played. The 5 b is an add-on, the others are integral. Thus, though this Richter A blues doesn't have the 5 bs it is still employable. Whereas the Richter C blues scale stops at holes two and four as the integral 3 bs (Ebs) are absent.

TABLE 1

| Richter Tuning | | | | | | | | | | |
|---|---|---|---|---|---|---|---|---|---|---|
| | | | | | | | | | $B_b$ | ← whole step blow bend |
| | | | | | | | $E_b$ | $F_\#$ | B | ← half step blow bends |
| C | E | G | C | E | G | C | E | G | C | |
| D | G | B | D | F | A | B | D | F | A | |
| $D_b$ | $F_\#$ | $B_b$ | $D_b$ | | $A_b$ | | | | | ← half step draw bends |
| | F | A | | | | | | | | ← whole step draw bends |
| | | $A_b$ | | | | | | | | ← $1_{1/2}$ step draw bend |

TABLE 2

| Half steps---------- | \| | \| | \| | \| | \| | \| | \| | \| | \| | \| | \| | \| |
|---|---|---|---|---|---|---|---|---|---|---|---|---|
| Major | 1 | | 2 | | 3 | 4 | | 5 | | 6 | | 7 |

TABLE 2-continued

| | | | | | | | | | | |
|---|---|---|---|---|---|---|---|---|---|---|
| Minor | 1 | 2 | $3_b$ | 4 | | 5 | $6_b$ | | $7_b$ |
| Major Pent | 1 | 2 | 3 | | | 5 | | 6 | |
| Minor Pent | 1 | | $3_b$ | 4 | | 5 | | | $7_b$ |
| Blues | 1 | | $3_b$ | 4 | $5_b$ | 5 | | | $7_b$ |

TABLE 3

| Richter G blues scale - G $B_b$ C $D_b$ D F | | | | | | | | | | 12 notes |
|---|---|---|---|---|---|---|---|---|---|---|
| C | | G | C | | G | — | — | — | — | |
| D | G | | D | F | | | | | | |
| $D_b$ | | $B_b$ | $D_b$ | | | | | | | |
| | F | | | | | | | | | |

TABLE 4

| Richter D blues scale - D F G $A_b$ A C | | | | | | | | | | 19 notes |
|---|---|---|---|---|---|---|---|---|---|---|
| C | | G | C | | G | C | | G | C | |
| D | G | | D | F | A | | D | F | A | |
| | | | | | $A_b$ | | | | | |
| | F | A | | | | | | | | |
| | | $A_b$ | | | | | | | | |

TABLE 5

| Richter C blues scale - C ($E_b$) F $G_b$ G $B_b$ | | | | | | | | | | 6 notes |
|---|---|---|---|---|---|---|---|---|---|---|
| — | — | G | C | — | — | — | — | — | — | |
| | G | | | | | | | | | |
| | $G_b$ | $B_b$ | | | | | | | | |
| | F | | | | | | | | | |

TABLE 6

| Richter C blues scale - C $E_b$ F $G_b$ G $B_b$ | | | | | | | | | | 7 notes |
|---|---|---|---|---|---|---|---|---|---|---|
| | | | | | | | | | $B_b$ | |
| | | | | | | | $E_b$ | $G_b$ | | |
| — | — | — | — | — | — | — | C | — | G | C |
| | | | | | | | | F | | |

TABLE 7

| Richter A blues scale - A C D ($E_b$) E G | | | | | | | | | | 17 notes |
|---|---|---|---|---|---|---|---|---|---|---|
| C | F | G | C | E | G | C | E | G | C | |
| D | G | | D | | A | | D | | A | |
| | | A | | | | | | | | |

I will use the term "trill" for any two adjacent consecutive scale tones on blow or draw cavities/holes. Table 8 illustrates a trill section in C major. The stylistic effect of moving between these two holes with celerity is called a trill. Table 8 also illustrates the same two notes arranged so they are not a trill. The blow, draw configuration cannot produce a trill effect.

I will use the term "glissando" for any three or more adjacent consecutive scale tones on blow or draw cavities. Table 9 illustrates a C Major 4-note draw glissando section and the same 4 notes configured so they are not a glissando. The notes of a glissando section can be executed with celerity and grace unattainable with a blow, draw, blow, draw combination. The presence of trill and glissando sections promotes ease of playability and musicality.

None of the Richter blues scales have a glissando section. The G blues scale has 1 trill, D blues scale has 2 trills and A blues scale has 3 trills.

The most playable minor scale on Richter is A minor (Table 10). The primary tonic note (the lower one) is on a whole step bend. The tonic more than any other note needs to be sounded on pitch and with conviction and this is difficult to do on a whole step bend, too difficult for most players and even if you could do it, it's not pleasant. Rare is the individual who plays in Key of A on a Key of C Richter harmonica (aka. $4^{th}$ position).

TABLE 8

| Trill | Not Trill |
|---|---|
| C D | C<br>D |

TABLE 9

| Glissando | | | | Not Glissando | |
|---|---|---|---|---|---|
| | | | | C<br>D | E<br>F |
| C | D | E | F | | |

TABLE 10

| Richter A Minor-A B C D E F G | | | | | | | | | |
|---|---|---|---|---|---|---|---|---|---|
| C<br>D | E<br>G<br>F | G<br>B<br>A | C<br>D | E<br>F | G<br>A | C<br>B | E<br>D | G<br>F | C<br>A |

Advantages

Some advantages of one or more aspects are as follows: to provide more notes for playing blues scales and more trill and glissando sections for ease of playability and musicality and to provide some easily playable minor scales.

Detailed description—First Embodiment

One embodiment "Blue1" (Table 11) has a blow major chord (1-3-5) configured across the blow reeds followed by a repeating blow minor seven chord (1-3 b-5-7 b) of the same pitch and across the draw reeds is a draw major chord (G) followed by a repeating draw minor seven chord (Dmin7) that is a fifth higher than the draw major chord. For ease of playability, only draw bends are present.

TABLE 11

| Blue1 Tuning Key of C | | | | | | | | | |
|---|---|---|---|---|---|---|---|---|---|
| C<br>D<br>Db | E<br>G<br>Gb<br>F | G<br>B<br>Bb<br>A<br>Ab | C<br>D<br>Db | Eb<br>F<br>E | G<br>A<br>Ab | Bb<br>C<br>B | C<br>D<br>Db | Eb<br>F<br>E | G<br>A<br>Ab |

Operation

Table 12 charts Blue1 G blues scale which gives musicians another full octave to work with. This upper octave features two 3-hole glissando sections, one on the blow holes (G,Bb,C) and one on the draw holes (C,D,F). There are four trills available in this section G/Bb, Bb/C, C/D, and D/F. Table 13 charts Blue1 D blues scale. Which improves on Richter by providing a 4-hole draw glissando section (A,C,D,F), adding another C note and adding a 5 b bend (Ab) for expressiveness. Table 14 charts Blue1 C blues scale, which has the integral Eb in the middle octave which gives us the ability to play up to and including cavity 10 comfortably. It features a 4-hole blow glissando section (G,Bb,C,Eb) and the three trills G/Bb, Bb/C, and C/Eb. Table 15 charts Blue1 A blues where the 5 bs (Ebs) are present to generate two full blues scales. Blue1 tuning also has a functional F blues scale (Table 16) that is absent in Richter tuning. This affords musicians the option of playing in Key of C with C as the One , F as the Four and G as the Five. This is valuable musically as well as economically. You don't have to purchase an entirely different harmonica to play the blues in Key of C.

Further, Blue1 tuning has functional natural and harmonic minor scales. Table 17 charts Blue1 C natural minor and Table 18 charts Blue1 C harmonic minor. Additionally, Blue1 tuning provides the C phrygian (Table 19) and C dorian (Table 20) scales. This is valuable for composing and improvising in a minor key. As Blue1's holes 4-7 are a pattern that repeats as you progress up the harmonica, it easier to learn than a non-linear instrument. Table 21 depicts a 12-hole Blue1 harmonica to illustrate this sequence more clearly. Table 22 charts Blue1 by scale degrees.

TABLE 12

| Blue1 G Blues-G Bb C Db D F 19 notes | | | | | | | | | |
|---|---|---|---|---|---|---|---|---|---|
| C<br>D<br>Db | G<br>F | G<br>Bb | C<br>D<br>Db | F | G | Bb<br>C | C<br>D<br>Db | F | G |

TABLE 13

| Blue1 D Blues-D F G Ab A C 20 notes | | | | | | | | | |
|---|---|---|---|---|---|---|---|---|---|
| C<br>D | G<br>F | G<br>A<br>Ab | C<br>D | F | G<br>A<br>Ab | C | C<br>D | F | G<br>A<br>Ab |

TABLE 14

| Blue1 C Blues-C Eb F Gb G Bb 15 notes | | | | | | | | | |
|---|---|---|---|---|---|---|---|---|---|
| — | G<br>Gb<br>F | G<br>Bb | C | Eb<br>F | G | Bb<br>C | C | Eb<br>F | G |

TABLE 15

| Blue1 A Blues-A C D Eb E G 19 notes | | | | | | | | | |
|---|---|---|---|---|---|---|---|---|---|
| C<br>D | E<br>G | G<br>A | C<br>D | Eb<br>E | G<br>A | C | C<br>D | Eb<br>E | G<br>A |

TABLE 16

| Blue1 F Blues-F Ab Bb B C Eb | | | | | | | | | |
|---|---|---|---|---|---|---|---|---|---|
| | | | C | Eb | | Bb | C | Eb | |
| — | — | B | | F | — | C | | F | — |
| | | Bb | | | Ab | B | | | Ab |
| | F | | | | | | | | |
| | | Ab | | | | | | | |

TABLE 17

| Blue1 C Natural Minor-C D Eb F G Ab Bb | | | | | | | | | |
|---|---|---|---|---|---|---|---|---|---|
| | | G | C | Eb | G | Bb | C | Eb | G |
| — | G | | D | F | | C | D | F | |
| | | Bb | | | Ab | | | | Ab |
| | F | | | | | | | | |
| | | Ab | | | | | | | |

TABLE 18

| Blue1 C Harmonic Minor-C D Eb F G Ab B | | | | | | | | | |
|---|---|---|---|---|---|---|---|---|---|
| | | G | C | Eb | G | | C | Eb | G |
| — | G | B | D | F | | C | D | F | |
| | | | | | Ab | B | | | Ab |
| | F | | | | | | | | |
| | | Ab | | | | | | | |

TABLE 19

| Blue1 C Phrygian-C Db Eb F G Ab Bb | | | | | | | | | |
|---|---|---|---|---|---|---|---|---|---|
| | | G | C | Eb | G | Bb | C | Eb | G |
| — | G | | | F | | C | | F | |
| | | Bb | Db | | Ab | | Db | | Ab |
| | F | | | | | | | | |
| | | Ab | | | | | | | |

TABLE 20

| Blue1 C Dorian-C D Eb F G A Bb | | | | | | | | | |
|---|---|---|---|---|---|---|---|---|---|
| | | G | C | Eb | G | Bb | C | Eb | G |
| — | G | | D | F | A | C | D | F | A |
| | | Bb | | | | | | | |
| | F | A | | | | | | | |

TABLE 21

| Blue1 12 hole | | | | | | | | | | | |
|---|---|---|---|---|---|---|---|---|---|---|---|
| C | E | G | C | Eb | G | Bb | C | Eb | G | Bb | C |
| D | G | B | D | F | A | C | D | F | A | C | D |
| Db | Gb | Bb | Db | E | Ab | B | Db | E | Ab | B | Db |
| | F | A | | | | | | | | | |
| | | Ab | | | | | | | | | |

TABLE 22

| Blue1 by scale degrees | | | | | | | | | |
|---|---|---|---|---|---|---|---|---|---|
| 1 | 3 | 5 | 1 | 3b | 5 | 7b | 1 | 3b | 5 |
| 2 | 5 | 7 | 2 | 4 | 6 | 1 | 2 | 4 | 6 |

Additional Embodiment Description

Embodiment Blue2

An alternative embodiment of Blues tuning is shown in Table 23. The Fs of Blue1 are F#s here. This provides the 5 bs in the upper two octaves of the C blues scale and facilitates many other scales, but you now must access the F via a bend. It's a tradeoff. Table 24 charts Blue2 tuning by scale degrees.

TABLE 23

| Blue2 Key of C | | | | | | | | | |
|---|---|---|---|---|---|---|---|---|---|
| C | E | G | C | Eb | G | Bb | C | Eb | G |
| D | G | B | D | F# | A | C | D | F# | A |
| Db | Gb | Bb | Db | F | Ab | B | Db | F | Ab |
| | F | A | | E | | | | E | |
| | | Ab | | | | | | | |

TABLE 24

| Blue2 by scale degrees | | | | | | | | | |
|---|---|---|---|---|---|---|---|---|---|
| 1 | 3 | 5 | 1 | 3b | 5 | 7b | 1 | 3b | 5 |
| 2 | 5 | 7 | 2 | 4# | 6 | 1 | 2 | 4# | 6 |

Conclusion

As the reader can see Blues harmonica provides more notes and more trill and glissando sections when playing the blues. It also provides functional minor scales. Though the above examples are in a certain key, these can be made in all keys. Claims:

I claim:

1. A harmonica comprising a body providing a series of adjacent cavities and a plurality of reeds each of which is responsive to the passage of air to produce a musical note of a predetermined pitch, two reeds being associated with each cavity such that one reed is the blow reed responsive to blowing on said cavity and the other is the draw reed responsive to drawing on said cavity, said harmonica being characterized in that:

(a) said blow reeds are constructed and arranged such that theft predetermined pitches by scale degrees are 1, 3, 5, 1,3 b, 5, 7 b, 1, 3 b, 5 and (b) said draw reeds are constructed and arranged such that theft predetermined pitches by scale degrees are 2, 5, 7, 2, 4, 6, 1, 2, 4, 6.

2. A harmonica comprising a body providing a series of adjacent cavities and a plurality of reeds each of which is responsive to the passage of air to produce a musical note of a predetermined pitch, two reeds being associated with each cavity such that one reed is the blow reed responsive to blowing on said cavity and the other is the draw reed responsive to drawing on said cavity, said harmonica being characterized in that:

(a) said blow reeds are constructed and arranged such that their predetermined pitches by scale degrees are 1, 3, 5, 1, 3 b, 5, 7 b, 1, 3 b, 5 and (b) said draw reeds are constructed and arranged such that theft predetermined pitches by scale degrees are 2, 5, 7, 2, 4#, 6, 1, 2, 4#, 6.

* * * * *